United States Patent [19]

Ohe

[11] 4,421,462

[45] Dec. 20, 1983

[54] VARIABLE DISPLACEMENT PUMP OF VANE TYPE

[75] Inventor: Takeshi Ohe, Matsuyama, Japan

[73] Assignee: Jidosha Kiki Co., Ltd., Tokyo, Japan

[21] Appl. No.: 208,454

[22] Filed: Nov. 19, 1980

[30] Foreign Application Priority Data

Dec. 10, 1979 [JP] Japan ..... 54-160106
Sep. 29, 1980 [JP] Japan ..... 55-135485

[51] Int. Cl.[3] ..... F04B 49/02; F04B 49/08; F04C 2/00; F04C 15/02

[52] U.S. Cl. ..... 417/310; 418/15; 418/159

[58] Field of Search ..... 417/286, 310, 428, 440, 417/442; 418/15, 159

[56] References Cited

U.S. PATENT DOCUMENTS 3,120,814 2/1964 Mueller ..... 417/310
4,184,813 1/1980 Rylewski ..... 417/440
4,272,227 6/1981 Woodruff ..... 417/440

*Primary Examiner*—John J. Vrablik

*Attorney, Agent, or Firm*—Flynn, Thiel, Boutell & Tanis

[57] ABSTRACT

A pump of vane type which sucks in and discharges fluid includes a pump body which is provided with at least two sets of intake ports and discharge ports, which communicate with a low pressure chamber and a high pressure chamber, respectively. An intake port and a discharge port of each set is spaced apart in substantial coincidence with a spacing between a pair of adjacent vanes, and an intake port (or a discharge port) of a second set is located between an intake port and a discharge port of a first set. Means is provided which controls the communication between selected intake ports and the low pressure chamber and between selected discharge ports and the high pressure chamber. Depending on the control provided by the control means, the entire quantity of fluid which has been withdrawn into the space between a pair of vanes can be discharged to the high pressure chamber, or a part of the fluid may be returned to the low pressure chamber while discharging the remainder to the high pressure chamber, thus providing a variable discharge of fluid.

15 Claims, 18 Drawing Figures

VARIABLE DISPLACEMENT PUMP OF VANE TYPE

BACKGROUND OF THE INVENTION

The invention relates to a pump of vane type, and in particular, to a variable displacement pump of vane type capable of changing the fluid discharge therefrom.

A vane pump of unbalanced pressure type is known in the prior art which includes a truly circular rotor and a truly circular cam ring. By adjusting the eccentricity between the axis of the rotor and the axis of the cam ring, the fluid discharge can be readily changed, and a variety of variable displacement vane pumps have been in practical use. However, in a vane pump of balanced pressure type which defines a pair of pump sections at locations which are symmetrical with respect to the axis, the relative position of the rotor and the cam rimg is fixed, and hence it is not a simple matter to provide a variable displacement arrangement. While such attempt has been made in the prior art and several vane pumps of balanced pressure type have been proposed which provide a variable displacement, the known arrangements are complex in a construction or exhibit an increased size, resulting in an expensive structure, which stood in the way to their practical use.

SUMMARY OF THE INVENTION

It is an object of the invention to provide a variable displacement pump of vane type which can be constructed, not only as a vane pump of unbalanced pressure type, but can also be implemented as a vane pump of balanced pressure type for practical purposes.

It is another object of the invention to provide a vane pump capable of providing a variable fluid discharge with a simple construction without requiring a change in the relative position of the rotor and the cam ring.

According to the invention, a variable displacement pump of vane type is provided with at least two sets of intake ports and discharge ports. The spacing between an intake port and a discharge port of a first set as well as the spacing between an intake port and a discharge port of a second set are chosen in substantial coincidence with the spacing between a pair of adjacent vanes. Either intake or discharge port of the second set is located between the intake and the discharge port of the first set. Means is provided which controls the communication between selected intake ports and a low pressure chamber and between selected discharge ports and a high pressure chamber. A variable fluid discharge is obtained as a result of operation of the control means which controls the communication between the selected intake ports and the low pressure chamber and between the selected discharge ports and the high pressure chamber. The plurality of sets of intake ports and discharge ports are arranged so as to produce an overlap between different sets, and hence an increase in the circumferential length of the pump body can be suppressed, allowing a vane pump of a small size to be provided.

Above and other objects, features and advantages of the invention will become apparent from the following description of several embodiments thereof with reference to the drawings.

BRIEF DESCRIPTION OF THE DRAWINGS

FIG. 14(*b*) is a cross section of the arrangement shown in FIG. 12 taken along the line XIVb—XIVb shown in FIG. 12;

DESCRIPTION OF EMBODIMENTS

Figure 1:
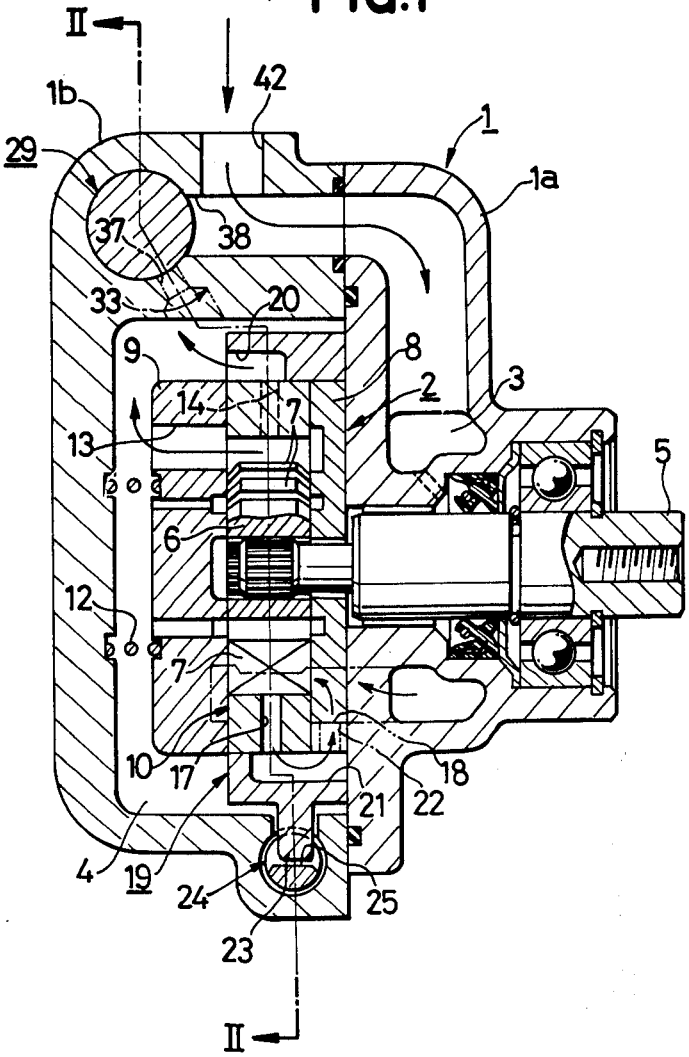
FIG. 1 is a cross section of a first embodiment of the invention taken along the line I—I shown in FIG. 2.
Figure 2:
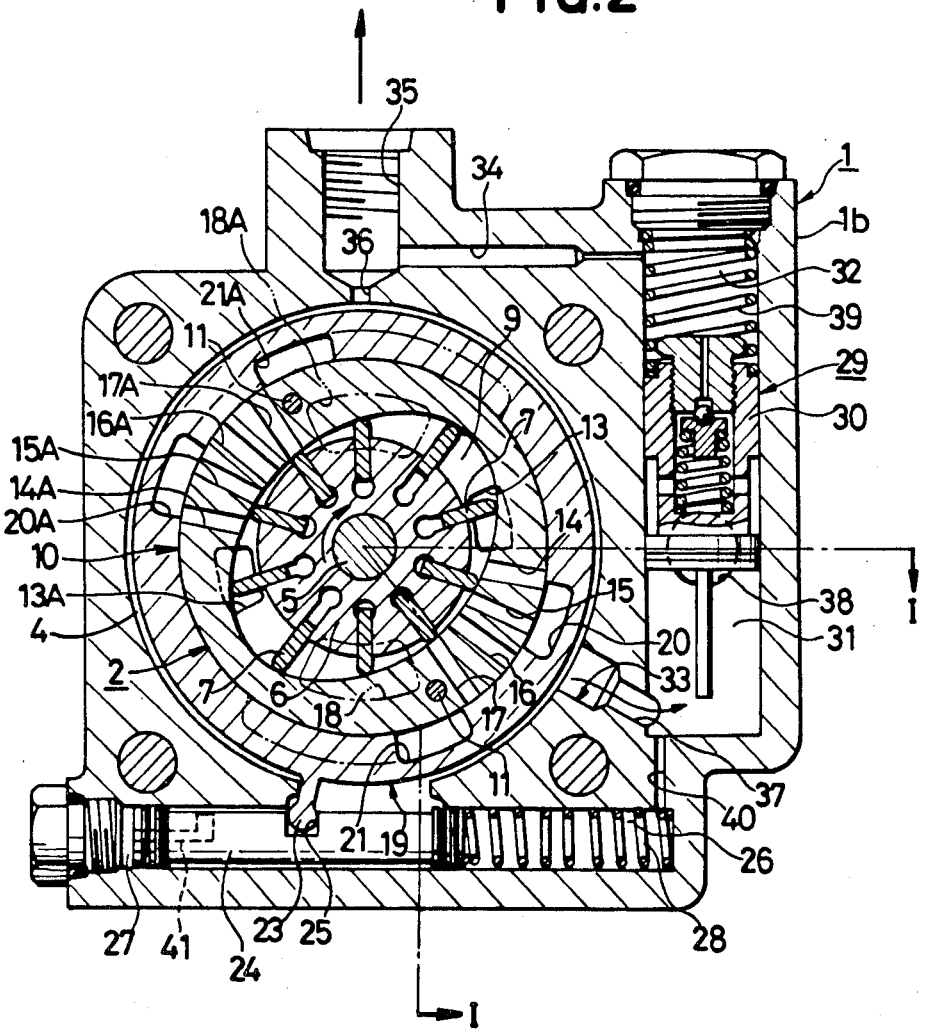
FIG. 2 is a cross section of the arrangement shown in FIG. 1 taken along the line II—II shown in FIG. 1.

Referring to FIGS. 1 and 2, there is shown a casing 1 which is formed by a front body 1*a* and a rear body 1*b*, which are disposed in abutting relationship with each other. A vane pump 2 is assembled into the casing 1, which is provided with a low pressure chamber 3, representing the fluid intake side of the pump 2, and a high pressure chamber 4 which represents the discharge side. The pump 2 comprises a rotor 6 which is driven for rotation by a drive shaft 5, a plurality of vanes 7 displaceably disposed in radially extending grooves formed in the rotor 6, a pair of side-plates 8 and 9 which are disposed against the opposite ends of the rotor 6 and the vanes 7, and an annular cam ring 10 located intermediate the both sideplates 8, 9 and against which the outer ends of the vanes 7 abut in sliding contact therewith.

A pair of pins 11 (see FIG. 2) extend through the both plates 8, 9 and the cam ring 10 in parallel relationship with the drive shaft 5, and are secured to the front body 1*a*, thus positioning these members in the direction of rotation. It is to be understood that the both plates 8, 9 and the cam ring 10 are displaceable in the axial directions of the pins 11, and the rotor 6 which is splined to the drive shaft 5 is also displaceable in the axial direction of the drive shaft 5, and the plates 8, 9, the cam ring 10 and the rotor 6 are urged to the right, as viewed in FIG. 1; by a spring 12 which is contained within the high pressure chamber 4, whereby they are positioned in the axial direction.

In a similar manner as a vane pump of balanced pressure type which is well known in the art, the vane pump 2 is provided with a pair of pump sections which are located symmetrically with respect to the axis of the rotor 6. Since both pump sections have an identical construction, only the first pump section will be described, the second pump section being designated by like reference numerals as used with the first pump section, followed by a letter A. In the present embodiment, the first pump section is provided with a first, a second and a third discharge port 13, 14, 15 and a first, a second and a third intake port 16, 17, 18, all sequentially disposed as viewed in the direction of rotation of the rotor 6. The first discharge port 13 is formed in the sideplate 9 and always communicates with the high pressure chamber 4 while the third intake port 18 is formed in the sideplate 8 and always communicates with the low pressue chamber 3. By contrast, the second and the third discharge port 14, 15 and the first and the second intake port 16, 17 which are located between them extend radially through the cam ring 10, and both discharge ports 14, 15 can be brought into communication with the high pressure chamber 4 while the both intake ports 16, 17 can be brought into communication with the low pressue chamber. It is to be understood that the three discharge ports and the three intake ports are combined in pairs. Specifically, the first discharge port 13 and the first intake port 16 form a pair as do the second discharge port 14 and the second intake port 16, and the third discharge port 15 and the third intake port 18. The spacing between the individual pairs, as viewed in the direction of rotation of the rotor 6, is chosen so that the spacing between the front edge, as viewed in the direction of rotation, of the discharge port and the rear edge, as viewed in the direction of rotation, of the intake port of each pair is substantially in coincidence with the spacing between a pair of adjacent vanes 7.

The first pump section and the second pump section are related to each other such that the spacing between the front edge, as viewed in the direction of rotation, of the third intake ports 18, 18A and the rear edge, as viewed in the direction of rotation, of the first discharge ports 13A, 13 coincide with the spacing between a pair of vanes 7. The cam ring 10 has a cam profile such that when the pair of vanes 7 are situated at such positions, the volume of a vane chamber defined between such vanes 7 is at its maximum while the volume of the vane chamber is at its minimum when the pair of vanes 7 are situated at the location of the third discharge port 15 and the third intake port 18.

Both the cam ring 10 and the sideplate 8 have a truly circular outer circumference of an equal diameter, and are surrounded by a cylindrical rotatable control member 19 which is formed with a discharge passage 20 (20A) and an intake passage 21 (21A). The pair of discharge and intake passages 20, 21 are associated with the first pump section while another pair is associated with the second pump section. Because these pairs of passages have an identical construction, only one pair will be described. The discharge passage 20 is formed in the inner surface of the cylindrical control member 19 and communicates with the high pressure chamber 4. The intake passage 21 is also formed in the inner surface of the control member 19, but communicates with the third intake port 18 and hence to the low pressure chamber 3 through a passage 22 which is formed in the sideplate 8. The discharge passage 20 has a circumferential width which permits it to communicate with the second and the third discharge port 14, 15 simultaneously, and the intake passage 21 has a circumferential width which permits it to communicate with the first and the second intake ports 16, 17 simultaneously. However, the location of these passages 20, 21 is chosen such that whenever the discharge passage 20 communicates with the second and the third discharge port 14, 15 simultaneously, the intake passage 21 is out of communication with the first and the second intake ports 16, 17 to interrupt the communication between these intake ports 16, 17 and the low pressure chamber 3 (see FIG. 2) while whenever the discharge port 20 communicates with the second discharge port 14 alone, the intake passage 21 communicates with the second intake port 17 alone (see FIG. 3) and whenever the discharge passage 20 is out of communication with the second and the third discharge ports 14, 15 to interrupt the communication between these discharge ports and the high pressure chamber 4, the intake passage 21 can communicate with the first and the second intake ports 16, 17 simultaneously (see FIG. 4).

The control member 19 is provided with a tab 23 at a selected position on its outer periphery, and the free end of the tab 23 is engaged in a groove 25 formed in a spool valve 24 which is slidably fitted inside the casing 1. The arrangement is such that the angular position of the control member 19 can be changed in accordance with a movement of the spool valve to control communication between the discharge passage 20 and the intake passage 21 on one hand and the second and the third discharge ports 14, 15 and the first and the second intake port 16, 17 on the other hand. The opposite ends of the spool valve are formed with chambers 26, 27, and the chamber 26 receives a spring 28 therein which urges the spool valve 24 to its inoperative position (FIG. 2). In such position, the discharge passage 20 communicates with the second and the third discharge ports 14, 15, which in turn communicate with the high pressure chamber 4 while the intake passage 21 is out of communication with the first and the second intake ports 16, 17, which are therefore out of communication with the low pressure chamber 3.

A flow control valve 29 of a known form is disposed in the casing 1. The flow control valve 29 includes a spool valve 30 and a pair of chambers 31, 32 which are formed in the opposite ends of the spool valve 30. The chamber 31 communicates with the high pressure chamber 4 through a passage 33 while the other chamber 32 communicates with the high pressure chamber 4 through a passage 34 and a supply passage 34 which is in turn connected to a hydraulic apparatus, not shown, for supplying hydraulic fluid thereto. An orifice 36 is formed intermediate the length of the supply passage 35 to extend across the high pressure chamber 4 and the passage 34. Similarly, another orifice 37 is formed in the passage 33 and has a greater area of flow path than the orifice 36. The flow control valve 29 is provided with a bypass passage 38 which provides a communication between the chamber 31 and the low pressure chamber 3, and the communication between the bypass passage 38 and the chamber 31 is interrupted whenever the spool valve 30 is maintained in its inoperative position by means of a spring 39. The chamber 31, located downstream of the orifice 37, communicates with the chamber 26 formed in the spool valve 24 through a passage 40 while the other chamber 27 communicates with the high pressure chamber 4 through a clearance between the spool valve 24 and the wall of a bore in which it is slidably fitted and through an internal passage 41 which is formed in the spool valve 24. A return path 42 communicates with the low pressure chamber 3, and fluid from a hydraulic apparatus, not shown, is returned to the low pressure chamber 3 through this path.

Figure 5:
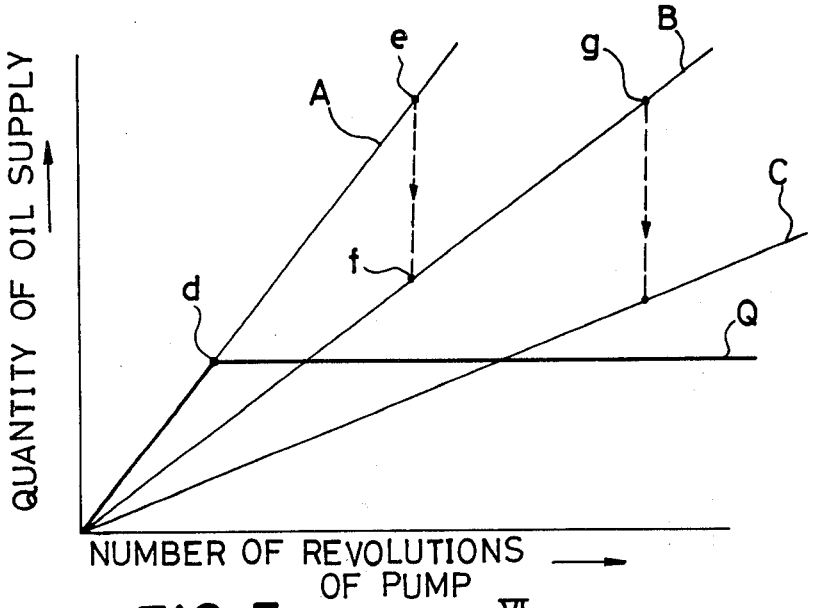
FIG. 5 graphically illustrates a fluid discharge plotted against the number of revolutions of the vane pump according to the first embodiment.

Under an inoperative condition, the control member 19 and the spool valve 24 assume positions shown in FIG. 2. As the rotor 6 is driven for rotation in a direction indicated by an arrow, it will be understood from the foregoing description that the volume of a vane chamber defined between a pair of adjacent vanes 7 will be at its maximum at the moment when the vane chamber communicates with the first discharge port 13, and then begins to decrease to its minimum value, which is reached at the moment when the chamber communicates with the third intake port 18. Under the conditions illustrated in FIG. 2, during the time the volume of the vane chamber varies from its maximum to its minimum value, the chamber will communicate with the high pressure chamber 4 through at least one of the first, the second and the third discharge ports 13, 14, 15 while the first and the second intake ports 16, 17 remain closed and thus cannot communicate with the low pressure chamber 3, so that the entire quantity of the volume change of the vane chamber will be discharged into the high pressure chamber 4. The resulting relationship between the discharge of the vane pump 2 and the number of revolutions of the pump is illustrated by a straight line A shown in FIG. 5.

While the number of revolutions of the rotor 6 is low, the spool valve 30 of the flow control valve 29 maintains the bypass passage 38 closed, and hence the entire hydraulic fluid discharged by the vane pump 2 is supplied to a hydraulic apparatus, not shown, through the supply passage 35. When the discharge from the vane pump 2 exceeds a given value indicated by a point d in FIG. 5, the flow control valve 29 operates to cause part of the fluid discharged from the vane pump to be returned to the low pressure chamber 3 through the bypass passage 38 as in the prior art practice, thus maintaining the fluid flow supplied to the hydraulic apparatus substantially constant, as indicated by a thick line Q in FIG. 5.

Such operation of the flow control valve 29 results from a pressure differential across the orifice 36. As the flow control valve 29 begins to cause part of the discharge fluid to be returned to the low pressure chamber 3 through the bypass passage 38, a pressure differential is produced across the orifice 37 which is disposed in the passage 33. When the return flow through the passage 33 increases or when the entire dischage increases to reach a point e shown in FIG. 5, the pressure differential across the orifice 37 increases to a point where the spool valve 24 is driven to move to the right, causing the control member 19 to rotate counter-clockwise, as viewed in FIG. 2, until the position shown in FIG. 3 is reached.

Figure 3:
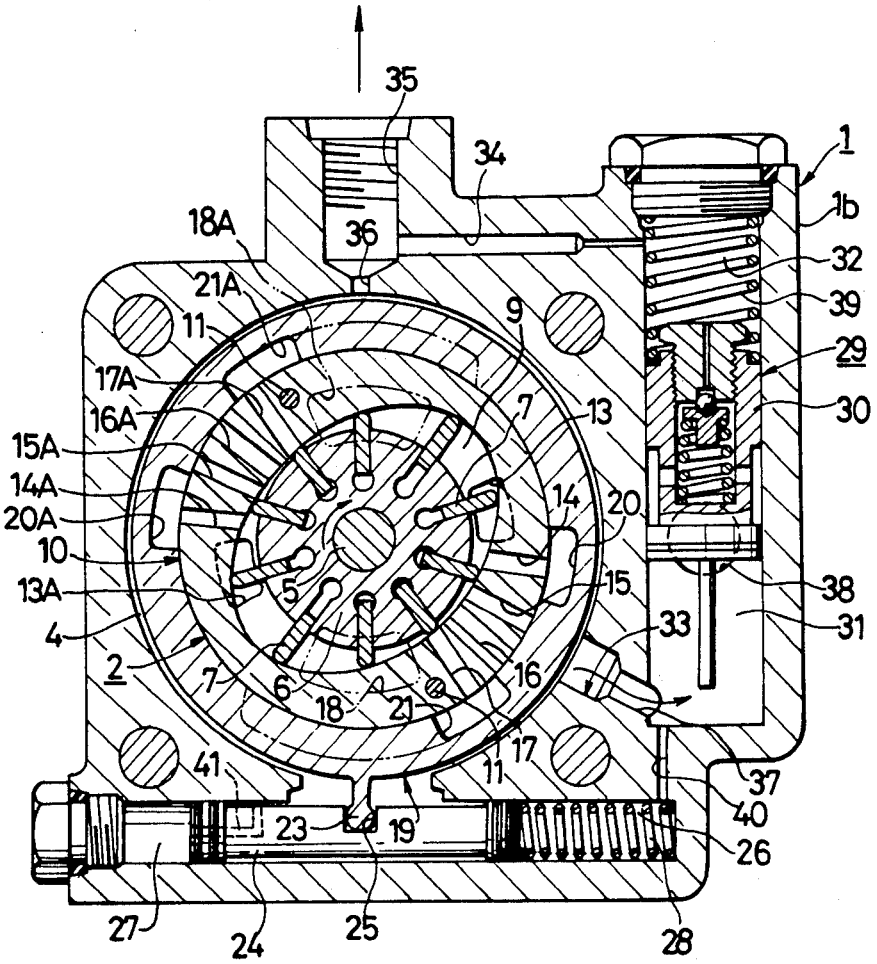
FIGS. 3 and 4 are cross sections illustrating different phases of operation from those shown in FIG. 2.

In the position of FIG. 3, the third discharge port 15 is closed while the second intake port 17 becomes open. Under this condition, the vane chamber communicates with the low pressure chamber 3 thorugh the second intake port 17, the intake passage 21, the passage 22 formed in the sideplate 8 and the third intake port 18 before the volume of the vane chamber reaches its minimum value, and that amount of the fluid which corresponds to the reduction in the volume which occurs from the initiation of communication with the second intake port 17 until the miminum volume is reached is returned to the low pressure chamber 3. Consequently, the fluid discharge to the high pressure chamber 4 is reduced as compared with that produced in the position of FIG. 2. The relationship between the discharge and the number of revolutions of the vane pump 2 under this condition is illustrated by another straight line B in FIG. 5. Thus, the discharge of the vane pump reduces from the point e to a point f on the line B. While pressure differentials across the orifices 36, 37 vary as a result of such change in the discharge, the arrangement will be eventually stabilized in the condition shown in FIG. 3.

Figure 4:
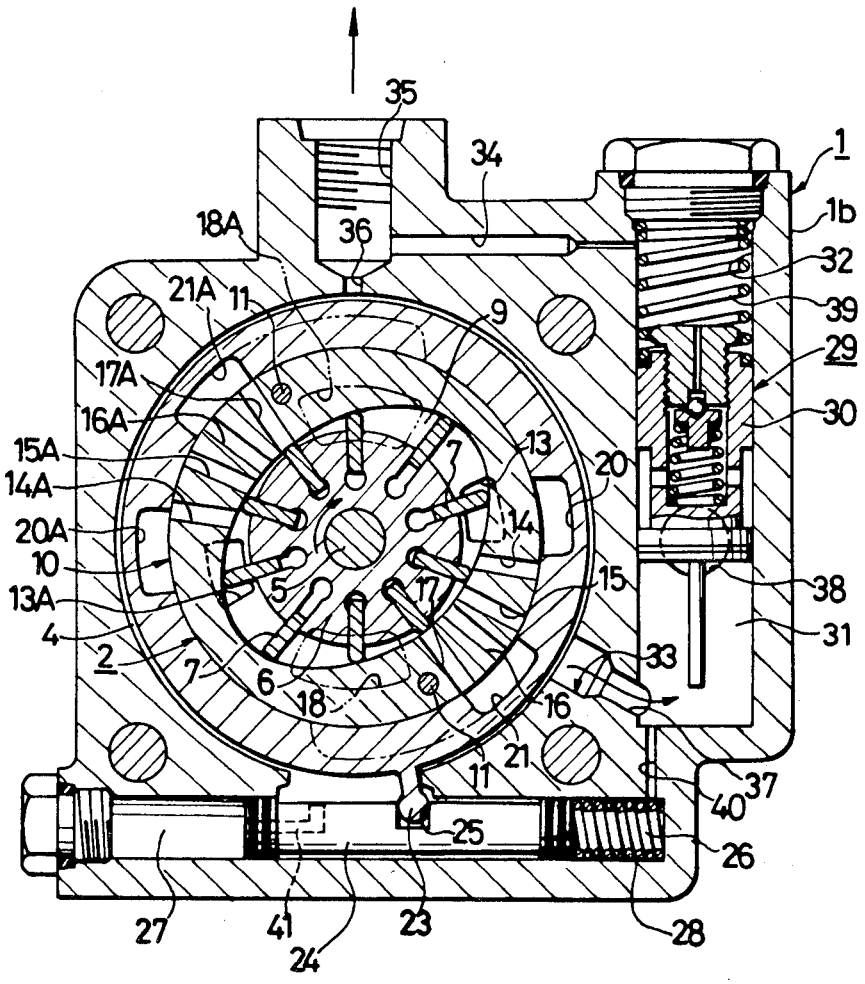

As the discharge fruther increases to reach a point g on the line B, the control member 19 is switched to the position shown in FIG. 4 where the second and the third discharge ports 14, 15 are closed while the first and the second intake ports 16, 17 are opened, with result that the vane chamber will return a greater amount of fluid to the low pressure chamber 3 than it did in the position of FIG. 3. Consequently, the flow response of the vane pump 2 will be further reduced as indicated by a further straight line C in FIG. 5.

FIGS. 6 to 10 show another embodiment of the invention, which principally differs from the first embodiment described above in that while in the first embodiment, the fluid is returned from the vane chamber to the low pressure chamber toward the end of a stroke during which the volume of the vane chamber decreases from its maximum to its minimum value, the fluid in the vane chamber is returned to the low pressure chamber toward the beginning of such decreasing stroke in the present embodiment, and in that the control member comprises a disc which is partly notched.

Specifically, the present embodiment includes a rear body **101*b* in which a low pressure chamber 103 representing the intake side and a high pressure chamber 104 representing the discharge side of a vane pump 102 are formed, which are thus formed on one side of the vane pump 102. The both chambers 103, 104 are separated by a partition 143 which is integral with the rear body 101*b*. Again, the vane pump 102 is provided with a pair of pump sections which are located symmetrically with respect to the axis of a rotor 106. Considering the first pump section, it comprises a first, a second and a third intake port 144, 145, 146, and a first, a second and a third discharge port 147, 148, 149 disposed in the sequence named as viewed in the direction of rotation of the rotor 106. All of these intake and discharge ports are formed in a sideplate 109, and the individual intake ports 144 to 146 communicate with the low pressure chamber 103 while the individual discharge ports 147 to 149 communicate with the high pressure chamber 104**.

It is to be understood that the intake and the discharge ports are combined in pairs, namely, the first intake port 144 forming a pair with the first discharge port 147, the second intake port 145 forming a pair with the second discharge port 148 and the third intake port 146 forming a pair with the third discharge port 149. As in the first embodiment, the spacing, as viewed in the direction of rotation, of the ports of each pair is chosen in substantial coincidence with the spacing between a pair of adjacent vanes 107. The relationship between the first and the second pump section is such that the spacing between the third discharge ports, 149, 149A and the first intake ports 144A, 144 coincide with the spacing between the pair of vanes 107, while they are located such that the volume of the vane chamber reaches its minimum when the pair of vanes 107 are located at such positions while the volume of the vane chamber reaches its maximum value when the pair of vanes 107 are located at the first intake port 144 and the first discharge port 147.

A control member 119 which is used in the present embodiment is in the form of a disc which is partly notched and which has its end face disposed in the sliding contact with the outside of the sideplate 109. The control member 119 is formed with a pair of notches 150, 151 at selected locations, and sectors 152, 152A located across the notches 150, 151 serve as closure members which close the second and third intake ports 145, 146, and the first and second discharge ports 147, 148. The closure members or sectors 152 are spaced apart so that the first and the second discharge port are open when the second and the third intake port 145, 146 are closed. The closure sectors 152A are similarly constructed. The partition 143 which is integral with the rear body **101*b* is essentially provided with a surface which abuts against the end face of the sideplate 109, but the partition 143 is milled in regions 153, 154 which overlap the control member 119, by an amount which corresponds to the weight of the control member 119, as will be noted in FIG. 7. The notches 150, 151 are divided into pairs of passage portions 150*a*, 150*b*, 151*a*, 151*b* by part of the partition 143 which extend radially through the central portion of the notches. One of the passage portions, 150*a*, 151*a*, are each utilized as an intake passage while the remaining passage portions 150*b*, 151*b*** are used as a discharge passage.

The shank of the control member 119 is connected with a drive shaft 155 which is used to drive the control member. The drive shaft 155 is connected to a mechanism, not shown, which corresponds to the spool valve 24. Such mechanism may be constructed to angularly move the control member 119 to selected positions illustrated in FIGS. 8, 9 and 10, as by a solenoid depending on the number of revolutions of the vane pump 102 which is detected. In other aspects, the arrangement is substantially similar to the first embodiment, and identical or corresponding parts are designated by line numerals used in the first embodiment to which 100 is added.

Figure 7:
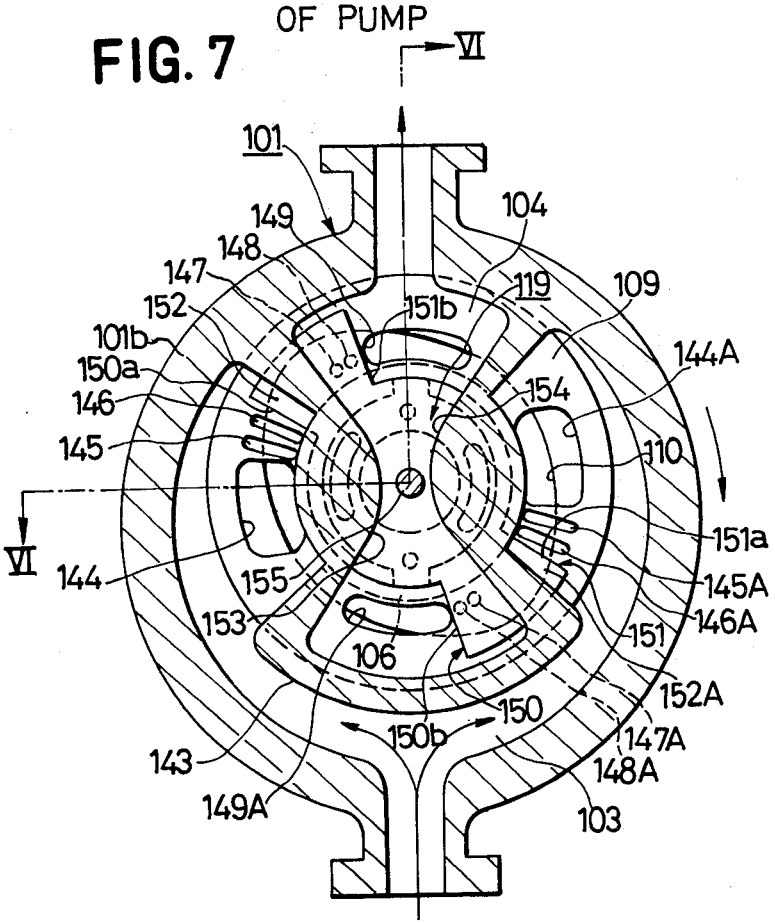
FIG. 7 is a cross section of the second embodiment taken along the line VII—VII shown in FIG. 6.
Figure 6:
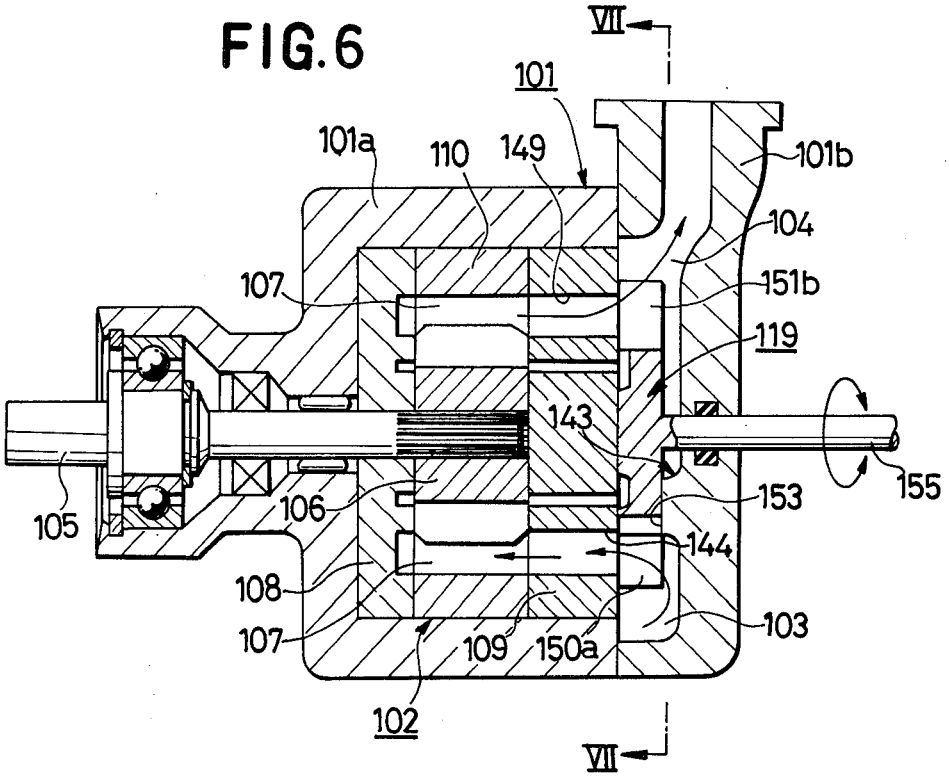
FIG. 6 is a cross section of a second embodiment of the invention taken along the line VI—VI shown in FIG. 7.
Figure 8:
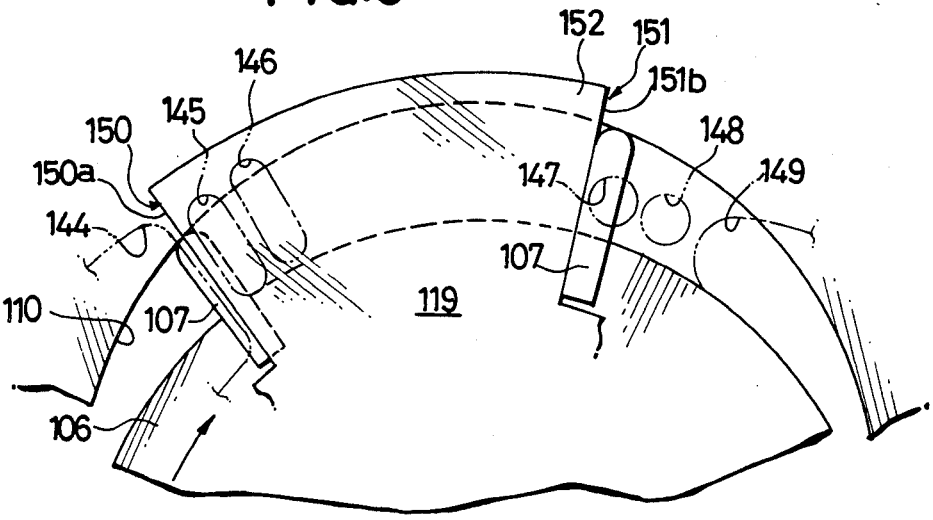
FIG. 8 is a fragmentary enlarged cross section of parts shown in FIG. 7.

In the present embodiment, the control member 119 assumes a position indicated in FIGS. 7 and 8 during the inoperative condition and a low speed operation of the vane pump 102. When the rotor 106 rotates in a direction indicated by an arrow under this condition, the volume defined between a pair of vanes 107 will reach its maximum value at the moment when the vane chamber defined therebetween communicates with the first intake port 144 (see FIG. 8) and then begins to decrease and reaches its minimum value at the moment when the vane chamber communicates with the first intake port (144A) of the second pump section. Under the condition illustrated in FIGS. 7 and 8, the vane chamber communicates with the high pressure chamber through at least one of the first, the second and the third discharge ports 147, 148, 149 during the time the volume of the vane chamber changes from its maximum to its minimum value, so that the entire quantity of the fluid is discharged into the high pressure chamber 104.

Figure 9:
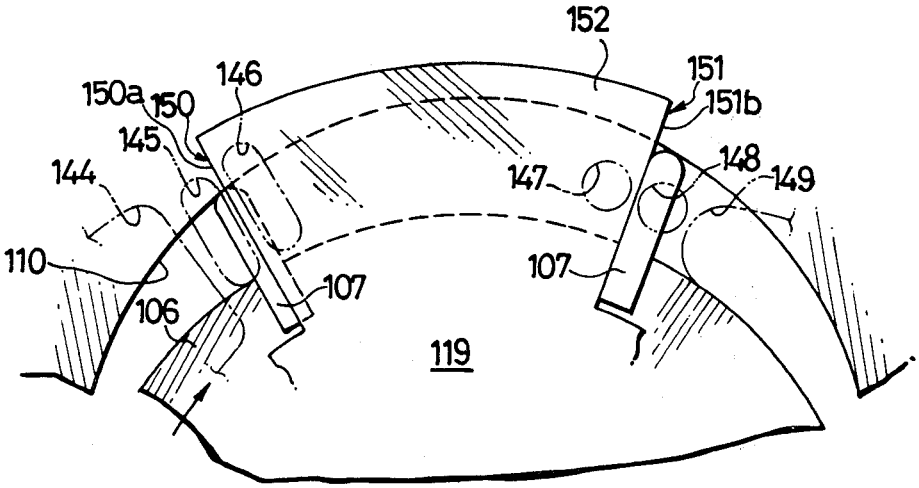
FIGS. 9 and 10 are enlarged cross sections illustrating different phases of operation from those illustrated in FIG. 8.

However, when the control member 119 is switched to the position shown in FIG. 9, the fluid discharge is reduced as compared with the fluid discharge achieved in the position of FIG. 8 since the volume of the vane chamber, which has reached its maximum value under the condition illustrated in FIG. 8, begins to decrease as the rotor 106 rotates, the fluid contained in the vane chamber is simultaneously returned to the low pressure chamber 103 through the second intake port 145, and the fluid in the vane chamber is discharged to the high pressure chamber 104 through the second and the third discharge port 148, 149 after the interruption of the communication between the vane chamber and the second intake port 145. By comparing the operation of this embodiment with that of the first embodiment, it will be noted that part of the fluid contained in the vane chamber is returned to the low pressure chamber during the initial portion of the stroke during which the volume of the vane chamber decreases in the present embodiment while the fluid in the vane chamber is partly returned to the low pressure chamber toward the end of such stroke in the first embodiment.

Figure 10:
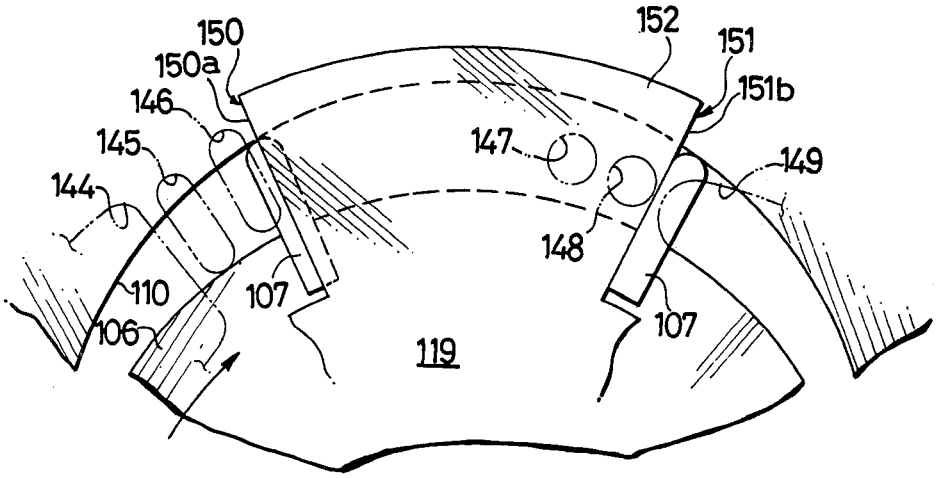

It will be evident that the fluid discharge from the vane pump 102 will be further reduced when the control member 119 is switched to the position shown in FIG. 10.

Figure 11:
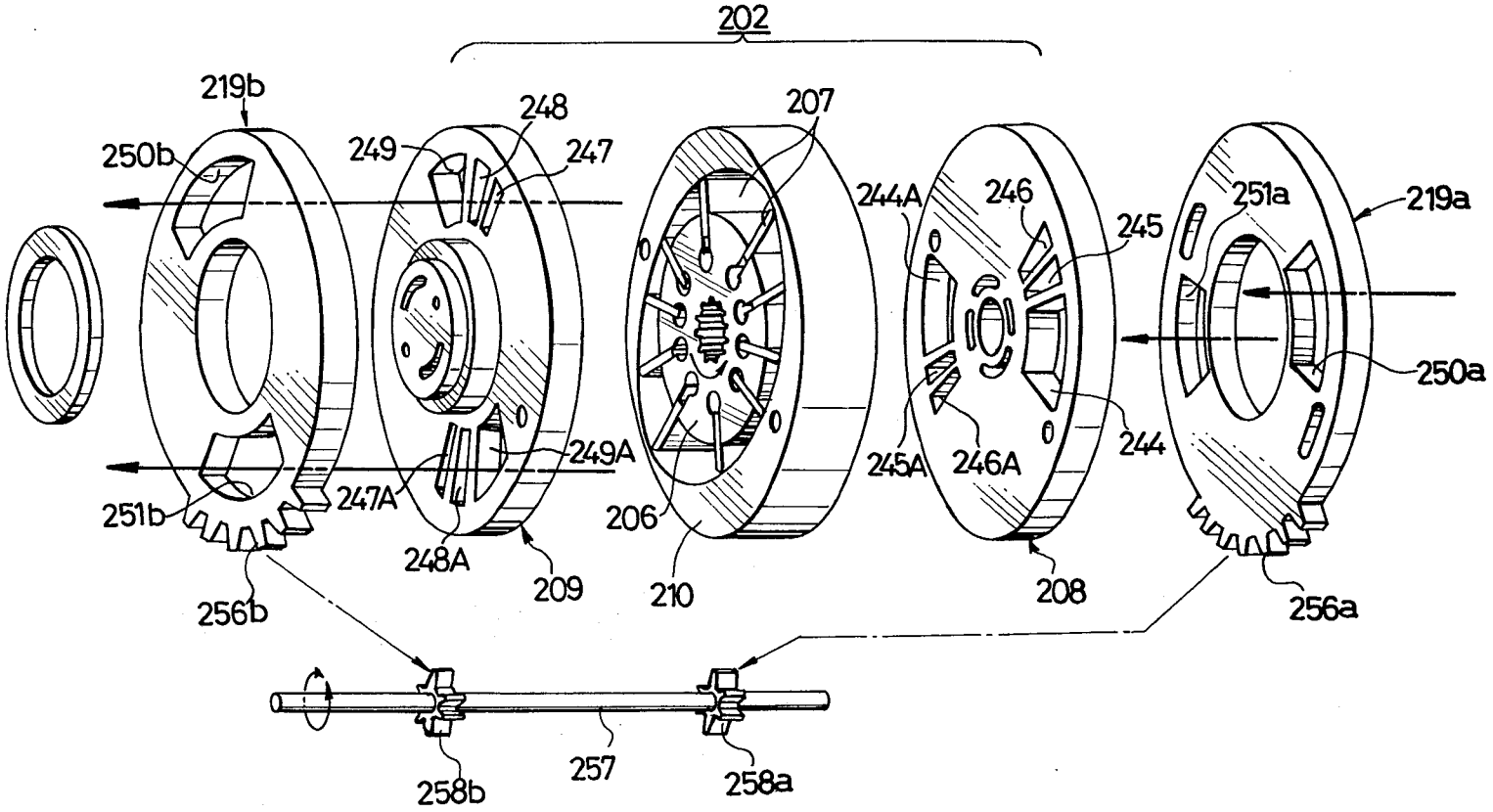
FIG. 11 is an exploded perspective view of essential parts of a third embodiment of the invention.

FIG. 11 shows a third embodiment of the invention which represents a modification of the second embodiment illustrated in FIGS. 6 to 10. In the second embodiment, all of the discharge and intake ports are formed in the single sideplate 109, but in the present embodiment, the discharge ports and the intake ports are formed in the separate sideplates. Specifically, in the present embodiment, intake ports 244, 245, 246 and 244A, 245A, 246A are formed in one of sideplates, 208, while discharge ports 247, 248, 249 and 247A, 248A, 249A are formed in the other sideplate 209. A pair of control members **219*a*, 219*b* are disposed outside the respective sideplates 208, 209. The control member 219*a* which is associated with the sideplate 208 is formed with intake passages 250*a*, 251*a* which correspond to the intake passages 150*a*, 151*a* of the second embodiment while the other control member 219*b* is formed with discharge passages 250*b*, 251*b*. The both control members 219*a*, 219*b* may be provided with teeth 256*a*, 256*b*, respectively, which mesh with pinions 258*a*, 258*b* which are integrally mounted on a drive shaft 257** for integral rotation.

It is to be understood that the relative relationship between the intake ports and the discharge ports in the present embodiment remains substantially the same as in the second embodiment, and hence a similar operation as that of the second embodiment can be achieved.

FIGS. 12 to 15 illustrate a fourth embodiment of the invention. In this embodiment, a first pump section includes nine intake ports 361 to 369 formed in one of sideplates, 308, at an equal interval, and nine discharge ports 371 to 379 formed in the other sideplate 309 at the same interval. In the embodiment shown, a cam ring 310 has an elliptical cam profile having a minor axis S which is located so that four of the intake ports 361 to 364 are located on the lagging side of the minor axis S and five of the intake ports 365 to 369 are located on the leading side of the minor axis, both as viewed in the direction of rotation of a rotor 306. Discharge ports 371 to 379 are located with respect to the cam ring 310 such that, as referenced to the location of the fourth intake port 364, the first discharge port 371 is spaced circumferentially of the rotor 306 by a spacing which coincides with the spacing between a pair of adjacent vanes 307. Consequently, the spacing between the fifth intake port 365 and the second discharge port 372 coincides with the spacing between the pair of vanes as do the pairs of the sixth, the seventh, the eighth and the ninth intake ports and the third, the fourth, the fifth and the sixth discharge ports, respectively. These intake ports 361 to 369 and the discharge ports 371 to 379 are formed in the inner surface of the respective sideplates 308, 309 as grooves which extend radially outward.

The second pump section is constructed in the same manner as the first pump section, and includes nine intake ports 361A to 369A which are positioned symmetrically to the intake and the discharge ports of the first pump section with respect to the axis of the rotor. The resulting relationship between the first and the second pump section is such that the spacing between the fourth discharge port 374, 374A of one of the pump sections and the first intake port 361A, 361 of the other pump section coincides with the spacing between the vanes.

The sideplates 308, 309 and the cam ring 310 which is located intermediate therebetween have truly circular outer peripheries of an equal diameter, and a cylindrical control member 319 is rotatably fitted thereon. The inner surface of the control member 319 is formed with a pair of intake passages 320, 320A of a width which permit their communication with four adjacent intake ports, and with a pair of discharge passages 321, 321A of a width which permit their communication with four adjacent discharge ports. The intake passages 320, 320A are always maintained in communication with the low pressure chamber 303 while the discharge passages 321, 321A are always maintained in communication with the high pressure chamber 304. The individual spacing between the passages 320, 321, 320A, 321A, which are four in total, coincides with the spacing between the vanes. Considering the intake passage 320 by way of example, the control member 319 is angularly movable, as viewed clockwise, from a position shown in FIG. 14 in which the intake passage 320 can communicate with the first to the fourth intake port 361 to 364 simultaneously to another position shown in FIG. 15 in which the intake passage 320 can communicate with the sixth to the ninth intake port 366 to 369 simultaneously.

Figure 14B:
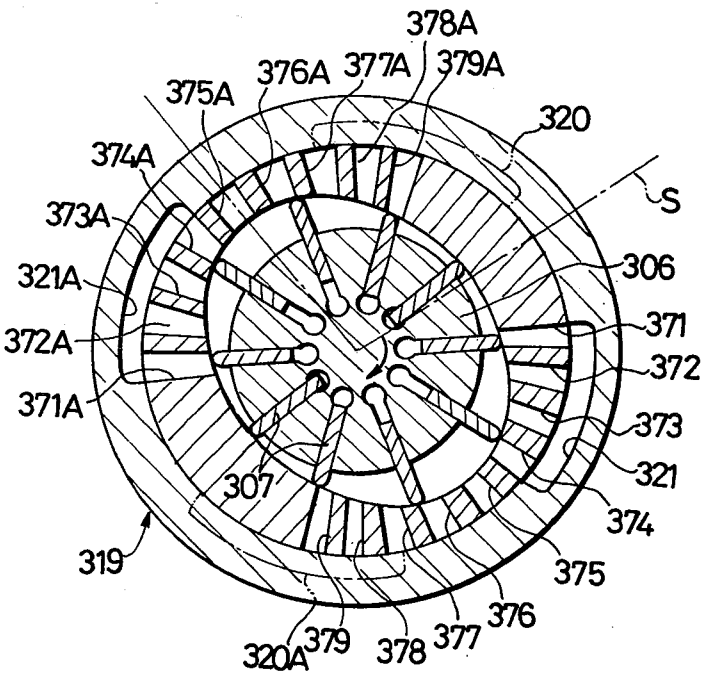
FIG. 14(*a*) is a cross section of the arrangement shown in FIG. 12 taken along the line XIVa—XIVa.
Figure 14A:
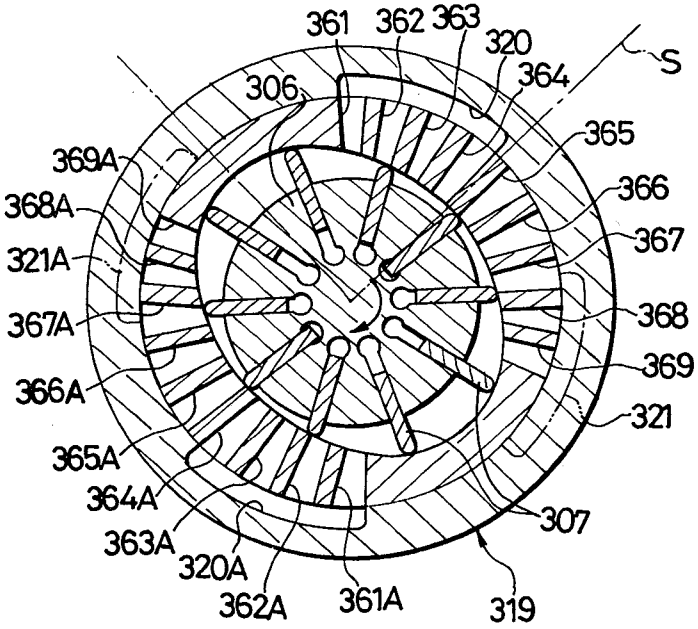

In the positions shown in FIG. 14, that is, when the intake passage 320 communicates with the first to the fourth intake ports 361 to 364 and the discharge port 321 communicates with the first to the fourth discharge ports 371 to 374, the fluid discharge from the vane pump 302 is substantially zero. Thus, at the moment when a vane chamber defined between a pair of adjacent vanes 307 communicates with the first intake port 361, the minor axis S of the cam profile is located intermediate the fourth and the fifth discharge port 364, 365 as mentioned previously, indicating that it is in the course of a stroke during which the volume of the vane chamber decreases, and hence the fluid contained in the vane chamber is discharged to the low pressure chamber 303 through the intake port 361 and the intake passage 320. On the other hand, when that vane chamber is disconnected from the fourth intake port 364, that one of the pair of vanes 307 defining the vane chamber which is located on the leading side has already significantly moved past the minor axis S, thus entering a stroke during which the volume of the vane chamber increases. In other words, the vane chamber shifts from its volume decreasing to its volume increasing stroke during a time interval from the moment the vane chamber communicates with the first intake port 361 until it is disconnected from the fourth intake port 364. Hence, by providing an arrangement that a decrement of the volume during the decreasing stroke is equal to an increment of the volume during the increasing stroke, there is no substantial movement of fluid between the vane chamber and the low pressure chamber 303.

After the vane chamber is disconnected from the fourth intake port 364, it then communicates with the high pressure chamber 304 through the first discharge port 371 and the discharge passage 321. The vane chamber is maintained in communication with the high pressure chamber 304 until its communication with the fourth discharge port 374 is disconnected, and in the meantime, the volume of the vane chamber shifts inversely from the increasing to the decreasing stroke, again causing no substantial movement of fluid between the vane chamber and the high pressure chamber 304.

When the communication with the fourth discharge chamber 374 is interrupted, the vane chamber is brought into communication with the low pressure chamber 303 through the first intake port 361A and the intake passage 320A of the second pump section, and subsequently the same function is performed as achieved by the first pump section.

It will be understood from the foregoing description that when the control member 319 is angularly moved in the direction of rotation of the rotor 306 to move the intake passage 320 and the discharge passage 321 such that the increment exceeds the decrement during the time the volume of the vane chamber which communicates with the low pressure chamber 303 through the intake passage 320 changes and such that the decrement exceeds the increment during the time the volume of the vane chamber which communicates with the high pressure chamber 304 through the discharge passage 321 changes, the vane pump 302 initiates a substantial discharge of fluid.

Figure 15B:
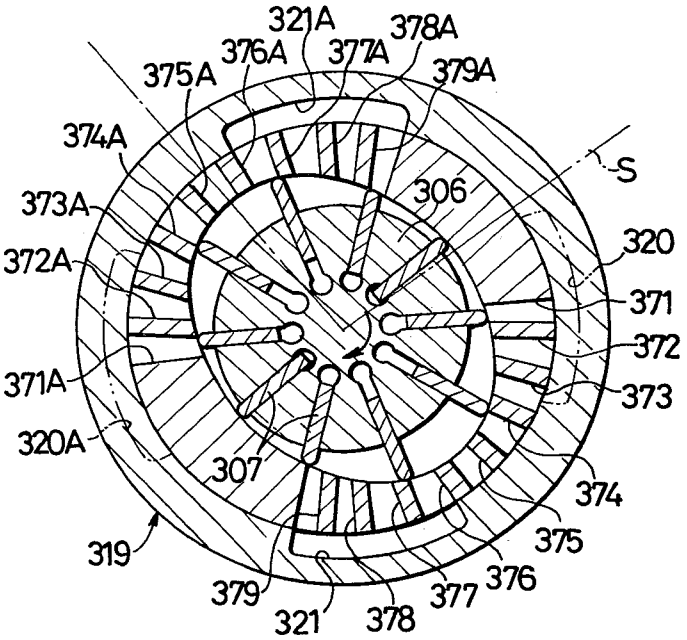
FIGS. 15(*a*) and (*b*) are cross sections illustrating different phases of operation from that shown in FIGS. 14(*a*) and (*b*)
Figure 15A:
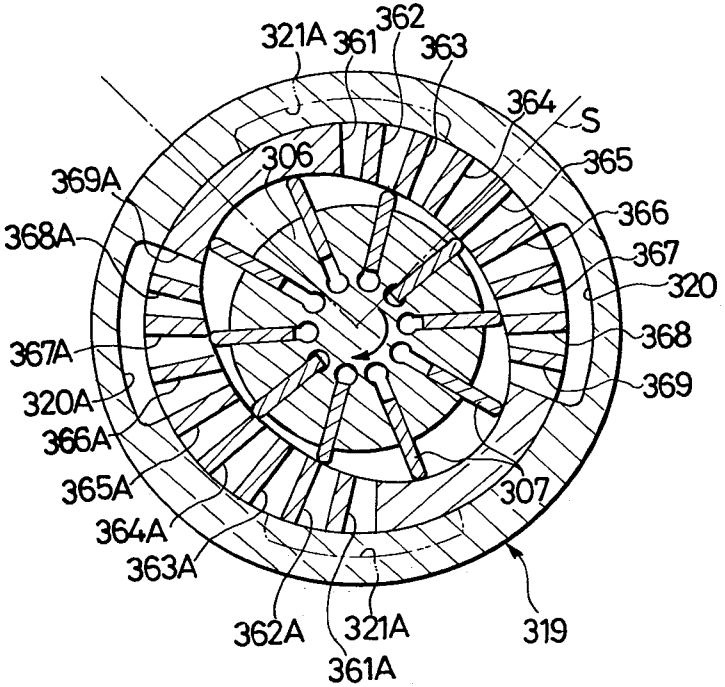

In the positions of FIG. 15, or when the intake passage 320 communicates with the sixth to the ninth intake port 366 to 369 and the discharge passage 321 communicates with the sixth to the ninth discharge port 376 to 379, the volume of the vane chamber which communicates with the low pressure chamber through those intake ports and the intake passage merely increases and the volume of the vane chamber which communicates with the high pressure chamber through these discharge ports and the discharge passage merely decreases, with consequence that the vane pump 302 provides a maximum discharge.

Figure 12:
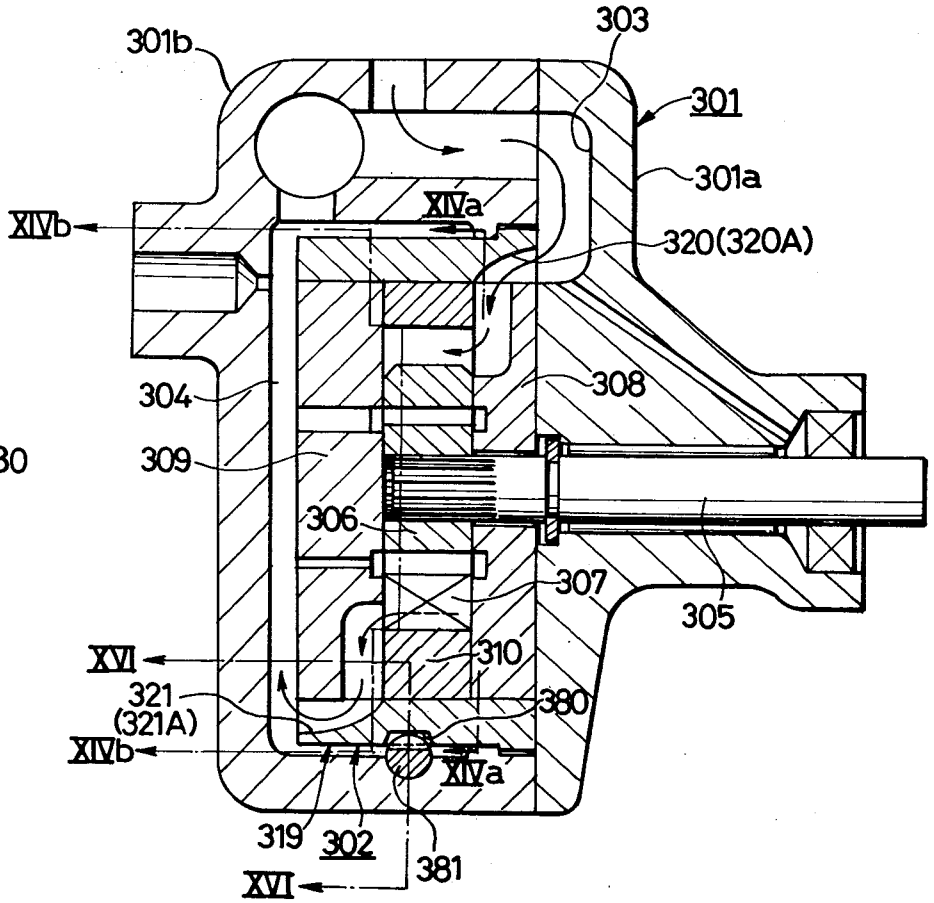
FIG. 12 is a cross section of a fourth embodiment of the invention in a manner similar to FIGS. 1 and 6.
Figure 16:
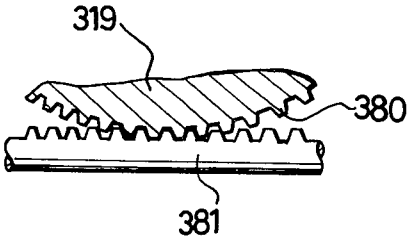
FIG. 16 is a cross section of the arrangement of FIG. 12 taken along the line XVI—XVI shown in FIG. 12.
Figure 13:
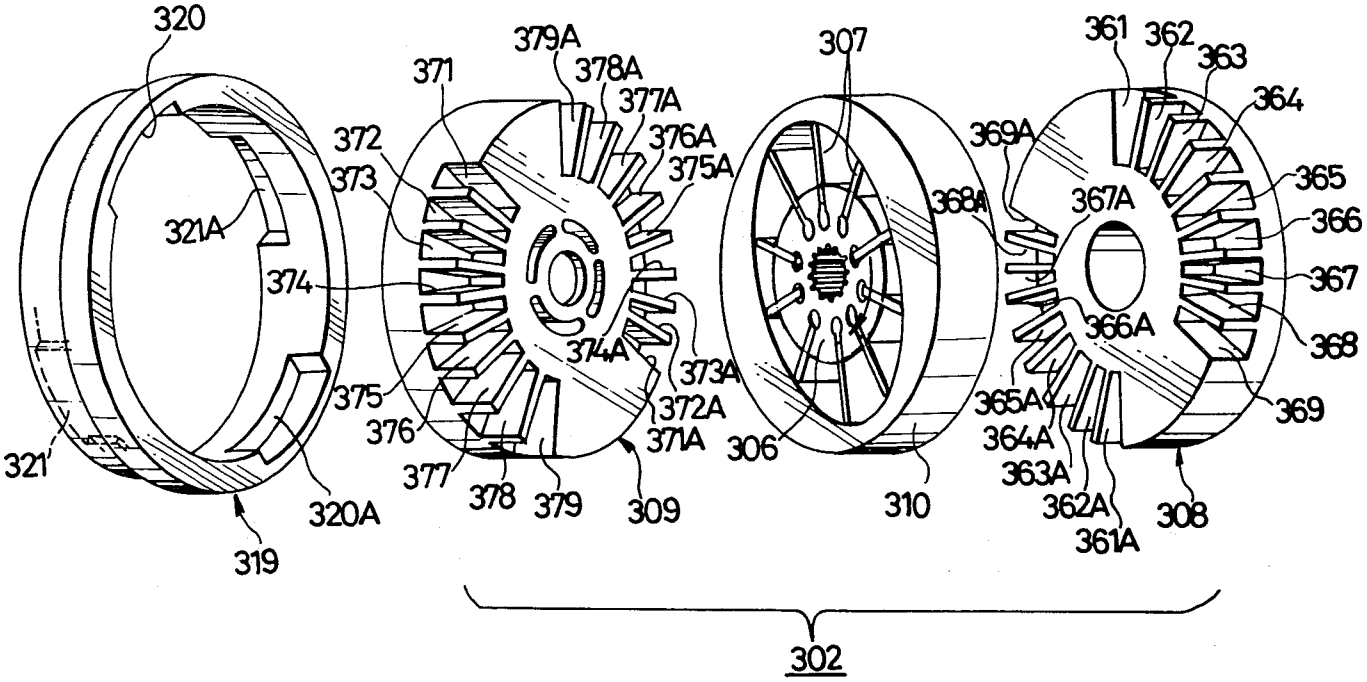
FIG. 13 is an exploded perspective view of essential parts shown in FIG. 12.

The control member 319 can be angularly moved by providing the control member 319 with teeth 380 in its outer periphery, as indicated in FIGS. 12 and 16, for meshing engagement with a rack 381 which slidably extends through the rear body 301*b* in a fluid-tight manner, with the rack 381 being driven for translational movement. By providing an additional number of intake and discharge ports so that the entire periphery of the respective sideplates 308, 309 is formed with the intake and discharge ports and by increasing the angle through which the control member 319 is movable, it is possible to reverse the direction of discharge from the vane pump 302, namely, to turn the intake side into the discharge side, depending on the angular position of the control member while maintaining a constant direction of rotation of the rotor 306.

It is to be understood that the expression "a substantial coincidence of the spacing between an intake port and a discharge port with the spacing between vanes" in accordance with the invention includes, in addition to a strict coincidence therebetween, an arrangement which is customarily employed and in which the spacing between an intake port and a discharge port during the volume decreasing stroke of the vane chamber is chosen slightly greater than the spacing between vanes so as to provide a compression of fluid within the vane chamber. In addition, where a cam profile is used which provides no volume change in the vane chamber, for example, where a volume increasing stroke is followed by a volume invariable zone which is in turn followed by a volume decreasing stroke, the spacing between an intake port and a discharge port can be increased beyond the spacing between vanes by an amount corresponding to the volume invariable zone when considered in configurational aspect, but the spacing therebetween is nevertheless in substantial coincidence with the spacing between vanes in respect of the pump operation. Such configuration is also included within the meaning of the above expression.

In the embodiment described above, the intake and the discharge port are opened or closed by the control member. However, solenoid valves may be disposed in a passage providing a communication between the individual intake ports and the low pressure chamber and in a passage providing a communication between the individual discharge ports and the high pressure chamber, with these solenoid valves being operated in response to an external electrical signal.

While specific embodiments of the invention have been shown and described above, it should be understood that various modifications and changes are possible therein by one skilled in the art without departing from the spirit and scope of the invention. Therefore, it is intended that all such modifications and changes as fall within the scope of the invention are covered by the appended claims.

What is claimed is:

1. In a variable displacement vane pump including a rotor which is driven for rotation by a drive shaft, a plurality of vanes displaceably disposed in radial grooves formed in the rotor, a pair of sideplates which abut against the opposite ends of the rotor and the vanes, a cam ring located between the both sideplates and against which the outer end of the vanes abut in sliding contact therewith, at least one intake port which permits a flow of a fluid into a vane chamber defined between a pair of adjacent vanes as the volume of the vane chamber increases, at least one discharge port which permits a flow of the fluid out of the vane chamber as the volume thereof decreases, a low pressure chamber disposed for communication with the intake port, and a high pressure chamber disposed for communication with the discharge port;

the improvement wherein the pump is of a balanced pressure type including a pair of pump sections which are located symmetrically to each other with respect to the drive shaft, each said pump section including at least two sets of intake and discharge ports, in each pump section the spacing between an intake port and a discharge port of the first set as well as the spacing between an intake port and a discharge port of the second set being chosen to be in substantial coincidence with the spacing between a pair of adjacent vanes, either the intake or the discharge ports of the second set being disposed intermediate the intake ports and the discharge ports of the first set, further including control means which controls a communication between selected intake port or ports and the low pressure chamber and a communication between a selected discharge port or ports and the high pressure chamber.

2. In a variable displacement vane pump type including a rotor which is driven for rotation by a drive shaft, a plurality of vanes displaceably disposed in radial grooves formed in the rotor, a pair of sideplates disposed in abutment against the opposite ends of the rotor and the vanes, a cam ring located between the both sideplates and against which the outer end of the vanes abut in sliding contact therein, at least one intake port which permits a flow of a fluid into a vane chamber defined between a pair of adjacent vanes as the volume thereof increases, at least one discharge port which permits a flow of the fluid out of the vane chamber as the volume thereof decreases, a low pressure chamber disposed for communication with the intake port, and a high pressure chamber disposed for communication with the discharge port;

the improvement wherein the pump is of a balanced pressure type including a pair of pump sections which are located symmetrically to each other with respect to the drive shaft, each said pump section including a plurality of sets of intake ports and discharge ports, in each pump section the spacing between an intake port and a discharge port of each of the first to the n-th set being chosen in substantial coincidence with the spacing between the pair of adjacent vanes, the intake ports of the first to the n-th set being sequentially formed circumferentially around the drive shaft in the sequence of the number of the respective sets as viewed in a given direction, the discharge ports of the first to the n-th set being sequentially disposed circumferentially in the sequence of the number of the respective sets in said given direction following the intake ports of the n-th set, the first set of intake ports being always maintained in communication with the low pressure chamber, the discharge ports of the n-th set being always maintained in communication with the high pressure chamber, further including a control means which controls the opening or closing of the intake ports of the second to the n-th set and the discharge ports of the first to the $(n-1)$-th set, the control means being operative to close the discharge ports of the first to the $(n-1)$-th set sequentially as the intake ports of the second to the n-th set are sequentially opened.

3. A variable displacement pump of vane type according to claim 2 in which the given circumferential direction represents the direction of rotation of the rotor.

4. A variable displacement pump of vane type according to claim 3 in which an arrangement is made such that when a pair of adjacent vanes is located in alignment with an intake port and a discharge port of the first set, the volume of the vane chamber defined between the pair of vanes is at its maximum.

5. A variable displacement pump of vane type according to claim 2 in which the given circumferential direction is opposite to the direction of rotation of the rotor.

6. A variable displacement pump of vane type according to claim 5 in which an arrangement is made such that when a pair of adjacent vanes are located in alignment with an intake port and a discharge port of the first set, the volume of a vane chamber defined between the pair of vanes is at its minimum.

7. A variable displacement pump of vane type according to claim 2 in which the intake ports of the first set and the discharge ports of the n-th set are formed in respective sideplates while the remaining intake ports and discharge ports are formed in the cam ring to open into the outer peripheral surface thereof, the control means comprising a cylindrical member which is fitted over the outer periphery of the cam ring to be rotatable in the circumferential direction thereof, the cylindrical member including a closure portion which is diposed in overlapping relationship with the opening of the intake and the discharge port to close them, an intake passage portion which may be brought into overlapping relationship with the opening of the intake port to permit its communication with the low pressure chamber, and a discharge passage portion which may be brought into overlapping relationship with the opening of the discharge port to permit its communication with the high pressure chamber.

8. A variable displacement pump of vane type according to claim 7 in which the intake ports of the first set are formed in one of the sideplates while the discharge ports of the n-th set are formed in the other sideplate.

9. A variable displacement pump of vane type according to claim 2 in which all of the intake ports and the discharge ports are formed in a common one of the sideplates, and a plate-shaped control member is disposed in overlapping relationship with the outer end face of the sideplate in which the ports are formed so as to be angularly movable in the direction of rotation of the rotor and in the opposite direction thereto, the disc-shaped control member including a closure portion which may be brought into overlapping relationship with the opening of the intake port and the discharge port to close them, an intake passage portion which may be brought into overlapping relationship with the opening of the intake port to permit its communication with the low pressure chamber, and a discharge passage portion which may be brought into overlapping relationship with the opening of the discharge port to permit its communication with the high pressure chamber.

10. A variable displacement pump of vane type according to claim 1 in which all of the intake ports are formed in one of the sideplates while all of the discharge ports are formed in the other sideplate, further including control means having a pair of annular control parts disposed in abutment against an outer portion of the respective sideplates and angularly movable in the direction of rotation of the rotor and in the opposite direction thereto, one of the annular control parts disposed in abutment against the sideplate in which the intake ports are formed including a closure portion which may be brought into overlapping relationship with the opening of a said intake port to close it, and an intake passage which may be brought into overlapping relationship with the opening of the latter said intake port to permit its communication with the low pressure chamber, the other control part including a closure portion which may be brought into overlapping relationship with the opening of the discharge port to close it, and a discharge passage which may be brought into overlapping relationship with a said opening of the discharge port to permit its communication with the high pressure chamber.

11. In a variable displacement vane pump including a rotor which is driven for rotation by a drive shaft, a plurality of vanes displaceably disposed in radial grooves formed in the rotor, a pair of sideplates disposed in abutment against the opposite ends of the rotor and the vanes, a cam ring located between the both sideplates and against which the outer end of the vanes abut in sliding contact therewith, at least one intake port which permits a flow of a fluid into a vane chamber defined between a pair of adjacent vanes as the volume thereof increases, at least one discharge port which permits a flow of the fluid out of the vane chamber as the volume thereof decreases, a low pressure chamber disposed for communication with the intake port and a high pressure chamber disposed for communication with the discharge port; the improvement wherein the pump is of a balanced pressure type including a pair of pump sections which are located symmetrically to each other with respect to the drive shaft, each said pump section including at least three sets of intake ports and discharge ports, in each pump section the spacing between an intake port and a discharge port of each of the first to an n-th set being chosen in substantial coincidence with the spacing between a pair of adjacent vanes, the intake ports and the discharge ports of the first to the n-th set being sequentially disposed in the sequence of the number of the respective sets circumferentially around the drive shaft in a given direction, the discharge ports or intake ports of at least the second set being disposed between the intake ports and the discharge ports of the first set, the discharge ports or intake port of at least the n-th set being disposed between the intake ports and the discharge ports of the (n−1)-th set and in a region offset from the space between the intake ports and the discharge ports of the first set, further including control means which controls a communication between a selected intake port or ports and the low pressure chamber and a communication between a selected discharge port or ports and the high pressure chamber.

12. A variable displacement pump of vane type according to claim 11 in which the circumferential spacing between adjacent sets is substantially equal to each other.

13. A variable displacement pump of vane type according to claim 12 in which the discharge ports of each set are disposed on the leadng side, as viewed in a given circumferential direction, of the intake ports of the corresponding set, one or two or more additional discharge ports being disposed on the leading side of the discharge ports of the n-th set in substantial coincidence with the circumferential spacing between adjacent sets, a number of additional intake ports which are equal in number to the additional discharge ports being disposed on the lagging side of the intake ports of the first set in substantial coincidence with the circumferential extent.

14. A variable displacement pump, comprising: a rotor and a drive shaft for rotating said rotor, said rotor having a plurality of radial grooves formed therein and a plurality of vanes disposed in said radial grooves and adapted to move radially therein; a pair of sideplates abutting against the opposite ends of said rotor and said vanes; a cam ring located between said sideplates and encircling said rotor and said vanes so that the radially outer ends of said vanes can abut against the internal wall of said cam ring in sliding contact therewith, wherein the pump is of a balanced pressure type including a pair of pump sections which are located symmetrically to each other with respect to the drive shaft, each said pump section including a corresponding group of intake ports for permitting fluid to flow into vane chambers defined between pairs of adjacent vanes as the volume of said vane chambers increases, all said intake ports being formed in one of said sideplates, a corresponding group of discharge ports for permitting fluid to flow out of said vane chambers as the volume of said vane chambers decreases, all of said discharge ports being formed in the other of said sideplates, the intake ports in each group being arranged in a circumferential spaced-apart series around said drive shaft with corresponding intake ports of said groups being substantially diametrically opposite each other, the discharge ports in each group being arranged in a circumferentially spaced-apart series around side drive shaft with corresponding discharge ports of said groups being substantially diametrically opposite each other with the first discharge port of a given group being circumferentially displaced from the first intake port of that given group in the direction of rotation of said rotor, the spacing between a given intake port and a given discharge port in said group being substantially equal to the spacing between the outer ends of a pair of adjacent vanes and the respective intake ports following said given intake port being similarly spaced from the corresponding discharge ports following said given discharge port, and a cylindrical control member mounted for rotation on the exterior of said cam ring and sideplates, said cylindrical control member having two intake passages adapted to communicate with a selected number of said intake ports of said two groups, respectively, said cylindrical control member having two discharge passages adapted to communicate with a selected number of sad discharge ports, respectively, said intake passages being continuously connected to the low pressure side of the pump and said discharge passages being continuously connected to the high pressure side of said pump.

15. In a variable displacement vane pump type including a rotor which is driven for rotation by a drive shaft, a plurality of vanes displaceably disposed in radial grooves formed in the rotor, a pair of sideplates disposed in abutment against the opposite ends of the rotor and the vanes, a cam ring located between the both sideplates and against which the outer end of the vanes abut in sliding contact therewith, at least one intake port which permits a flow of a fluid into a vane chamber defined between a pair of adjacent vanes as the volume thereof increases, at least one discharge port which permits a flow of the fluid out of the vane chamber as the volume thereof decreases, a low pressure chamber disposed for communication with the intake port, and a high pressure chamber disposed for communication with the discharge port;

the improvement wherein a plurality of set of intake ports and discharge ports are provided, the spacing between an intake port and a discharge port of each of the first to the n-th set being chosen in substantial coincidence with the spacing between the pair of adjacent vanes, the intake ports of the first to the n-th set being sequentially formed circumferentially around the drive shaft in the sequence of the number of the respective sets as viewed in a given direction, the discharge ports of the first to the n-th set being sequentially disposed circumferentially in the sequence of the number of the respective sets in said given direction following the intake ports of the n-th set, the first set of intake ports being always maintained in communication with the low pressure chamber, the discharge ports of the n-th set being always maintained in communication with the high pressure chamber, further including a control means which controls the opening or closing of the intake ports of the second to the n-th set and the discharge ports of the first to the (n−1)-th set, the control means being operative to close the discharge ports of the first to the (n−1)-th set sequentially as the intake ports of the second to the n-th set are sequentially opened, in which all of the intake ports are formed in one of the sideplates while all of the discharge ports are formed in the other sideplate, further including a pair of plate-shaped control members disposed in abutment against the outer end face of the respective sideplates and angularly movable in the direction of rotation of the rotor and in the opposite direction thereto, one of the control members disposed in abutment against the sideplate in which the intake ports are formed including a closure portion which may be brought into overlapping relationship with the opening of the intake port to close it, and an intake passage which may be brought into overlapping relationship with the opening of the intake port to permit its communication with the low pressure chamber, the other control member including a closure portion which may be brought into overlapping relationship with the opening of the discharge port to close it, and a discharge passage which may be brought into overlapping relationship with the opening of the discharge port to permit its communication with the high pressure chamber.

* * * * *

UNITED STATES PATENT AND TRADEMARK OFFICE

CERTIFICATE OF CORRECTION

PATENT NO. : 4 421 462

DATED : December 20, 1983

INVENTOR(S) : Takeshi Ohe

It is certified that error appears in the above-identified patent and that said Letters Patent is hereby corrected as shown below:

Column 13, line 44; change "claim 1" to ---claim 2---.

Column 15, line 13; change "side" to ---said---.

line 31; change "sad" to ---said---.

Column 16, line 3; change "set" to ---sets---.

Signed and Sealed this

*Twentieth* Day of *March 1984*

[SEAL]

*Attest:*

GERALD J. MOSSINGHOFF

*Attesting Officer*

*Commissioner of Patents and Trademarks*